US008028631B2

(12) United States Patent
Lauzier et al.

(10) Patent No.: US 8,028,631 B2
(45) **Date of Patent: *Oct. 4, 2011**

(54) RECONFIGURABLE PALLET USING LOCATOR BASES AND CLAMPS

(75) Inventors: Nicolas Lauzier, Ste-Flavie (CA); Robin Stevenson, Bloomfield, MI (US); Dalong Gao, Troy, MI (US); Robert Jacob Scheuerman, Washington, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 301 days.

This patent is subject to a terminal disclaimer.

(21) Appl. No.: 12/115,902

(22) Filed: May 6, 2008

(65) Prior Publication Data

US 2009/0277360 A1 Nov. 12, 2009

(51) Int. Cl.
*B65D 19/44* (2006.01)

(52) U.S. Cl. ..... 108/55.3; 108/55.1

(58) Field of Classification Search ..... 108/55.1, 108/55.3, 55.5, 56.1, 56.3, 51.11, 57.2; 410/98, 410/77, 81, 91; 206/386; 248/346.03
See application file for complete search history.

(56) References Cited

U.S. PATENT DOCUMENTS

| | | | | | |
|---|---|---|---|---|---|
| 3,622,114 | A * | 11/1971 | McIntire, Jr. | ..... | 108/55.5 |
| 3,753,407 | A * | 8/1973 | Tilseth | ..... | 108/55.3 |
| 4,015,710 | A * | 4/1977 | Biggs | ..... | 108/55.5 |
| 4,729,536 | A * | 3/1988 | Scala | ..... | 248/429 |
| 4,732,528 | A * | 3/1988 | Good | ..... | 108/55.1 |
| 4,774,892 | A * | 10/1988 | Ballard et al. | ..... | 108/55.3 |
| 4,782,763 | A * | 11/1988 | Salloum | ..... | 108/55.3 |
| 5,497,708 | A * | 3/1996 | Jeruzal | ..... | 108/55.3 |
| 5,722,330 | A * | 3/1998 | Staggers | ..... | 108/55.3 |
| 5,842,424 | A * | 12/1998 | Prevot et al. | ..... | 108/55.3 |
| 5,970,885 | A * | 10/1999 | Polando | ..... | 108/55.3 |
| 7,044,066 | B1 * | 5/2006 | Miller | ..... | 108/55.3 |
| 2004/0103826 | A1 * | 6/2004 | Ponzio | ..... | 108/55.3 |

* cited by examiner

*Primary Examiner* — Jose V Chen
(74) *Attorney, Agent, or Firm* — Quinn Law Group, PLLC

(57) ABSTRACT

A pallet includes a platform and a plurality of support assemblies located at multiple positions on the platform. One support assembly is associated with each location of the component to be supported. Each support assembly has a linkage assembly to support and enable movement of a support element. The support assemblies also each include multiple bases secured to the platform, to position the support element in a desired location for each version of a component. A locking mechanism on each base prevents movement of the support element when in the desired position. To configure the pallet for another version of the component the locking mechanism is released, the support element is moved to another base and the locking mechanism for that base is secured.

19 Claims, 5 Drawing Sheets

RECONFIGURABLE PALLET USING LOCATOR BASES AND CLAMPS

TECHNICAL FIELD

The present invention relates generally to pallets for assembly plants, and more specifically to a reconfigurable pallet.

BACKGROUND OF THE INVENTION

During assembly of vehicles in an assembly plant individual components must be supported prior to installation in the vehicle. In the case of heavy or bulky components it may be necessary or desirable to support these components in a specific configuration which facilitates installation of the component into the vehicle. For example, it may be desirable to support the component in an orientation which corresponds to its in-vehicle orientation and in a manner which enables access to locations, such as boltholes, used to attach the component to the vehicle.

An example of this is a vehicle engine or powertrain (i.e. engine plus transmission), where engine and powertrain specific support structures are used for the purpose of presenting the engine or powertrain to the vehicle body in a manner which facilitates attachment of the engine or powertrain to the vehicle body.

Commonly, customers may be offered various hardware options, such as engines or powertrains, with a specific vehicle body. Hence, to meet the need described above, multiple support structures must be employed each of which will be specific to a single hardware option or component version and which will be incapable of being used for other options. Frequently, for convenience and to ensure their strength and rigidity, these support structures are mounted on a platform. Together the support structure and the platform to which is attached constitute a pallet. As a result, a unique pallet is required for each version of the component associated with the assembly line.

SUMMARY OF THE INVENTION

A pallet that can be reconfigured to support multiple versions of a component associated with an assembly line is desired.

A pallet of the present invention includes a platform and a plurality of support assemblies located at multiple positions on the platform. One support assembly is associated with each support location of the component. The support assemblies each include a support element and a plurality of bases, one base for each version of the component to be supported.

The support element is positioned in the desired base. An interface on the base for receiving a footing of the support element places the support element in the desired location. The support element includes a locator. Once positioned in the base, the locator corresponds to a predetermined location on the component which has a mount for alignment. The height of the interface places the locator at the appropriate height for the mount of that version of the component.

The support element is constrained by a linkage assembly. The linkage assembly has a foundation secured to the platform. A first arm is rotatably connected to the foundation with a first joint and a second arm is rotatably connected to the first arm with a second joint. An aperture for receiving the support element is defined by the second arm.

Once the footing for the support element is received by the interface of the base and a locking mechanism is secured, the location of the support element is fixed. One locking mechanism is associated with each base. To configure the support assembly for another version of the component the locking mechanism is released. The footing is moved from the interface of the current base to the interface of another. The locking mechanism of that base secures the support element in position.

The support assemblies allow the pallet to quickly and easily be reconfigured by a single operator. Associating a locking mechanism with each base allows each support element to utilize only one linkage assembly for support and movement. Providing a reconfigurable pallet to be used with multiple versions of a component on an assembly line reduces costs.

The above features and advantages, and other features and advantages of the present invention will be readily apparent from the following detailed description of the preferred embodiments and best modes for carrying out the present invention when taken in connection with the accompanying drawings.

DESCRIPTION OF THE PREFERRED EMBODIMENTS

Figure 1:
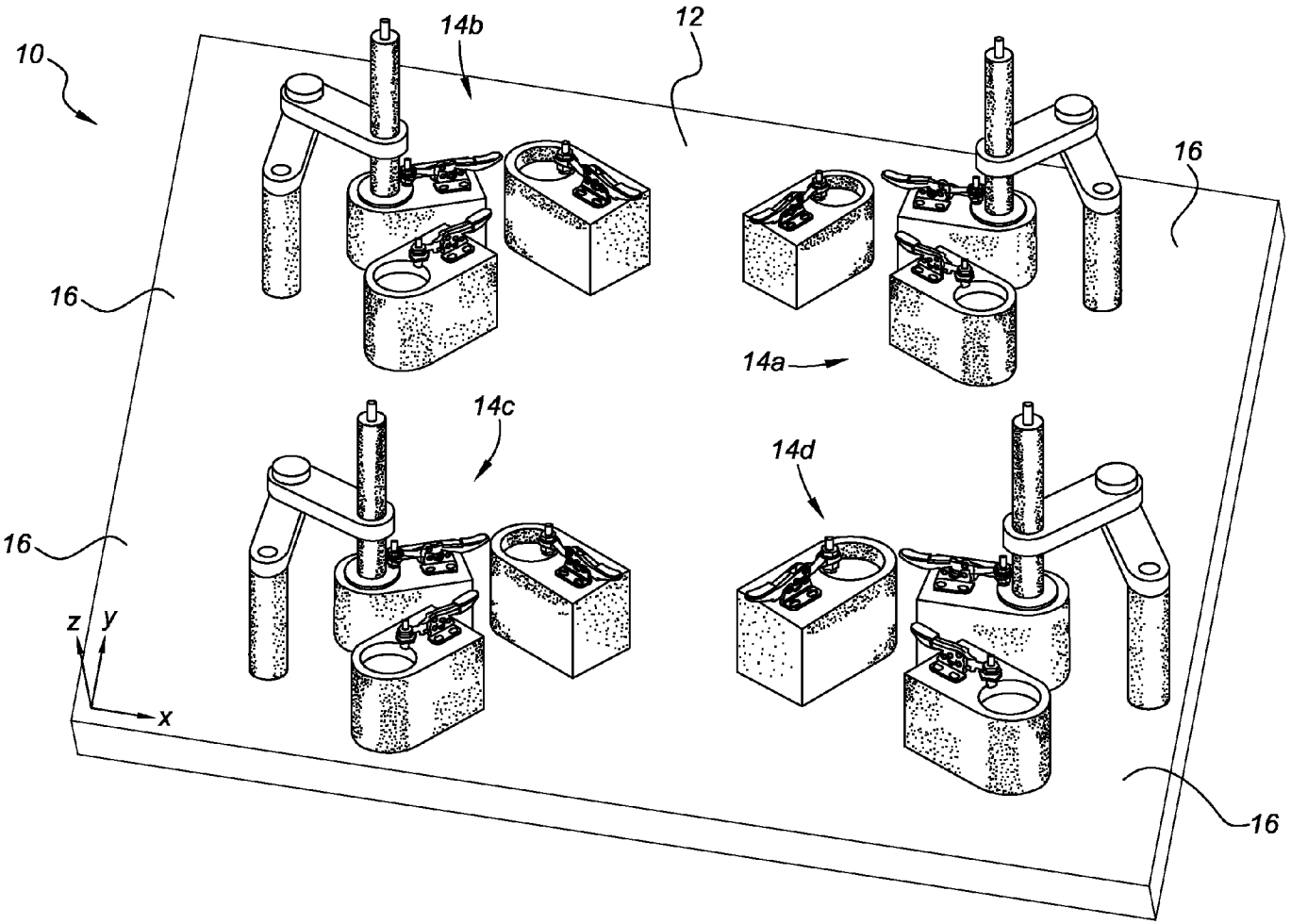
FIG. 1 is a perspective view illustrating a reconfigurable pallet of the present invention.

Referring to the Figures, wherein like reference numbers refer to the same or similar components throughout the several views, FIG. 1 is a perspective view of an exemplary pallet 10 of the present invention.

The pallet 10 includes a platform 12 and a plurality of support assemblies 14 located at multiple positions on the platform 12. As shown, four support assemblies 14*a-d* are located one at each corner 16 of the platform 12. One support assembly 14 is associated with each support location for the component. The number and location of the support assemblies 14 is determined by the design and type of the component to be supported. An x, y and z direction are defined by the pallet 10. Each support assembly 14*a-d* is located at a specific x-y-z coordinate as described below.

Figure 2:
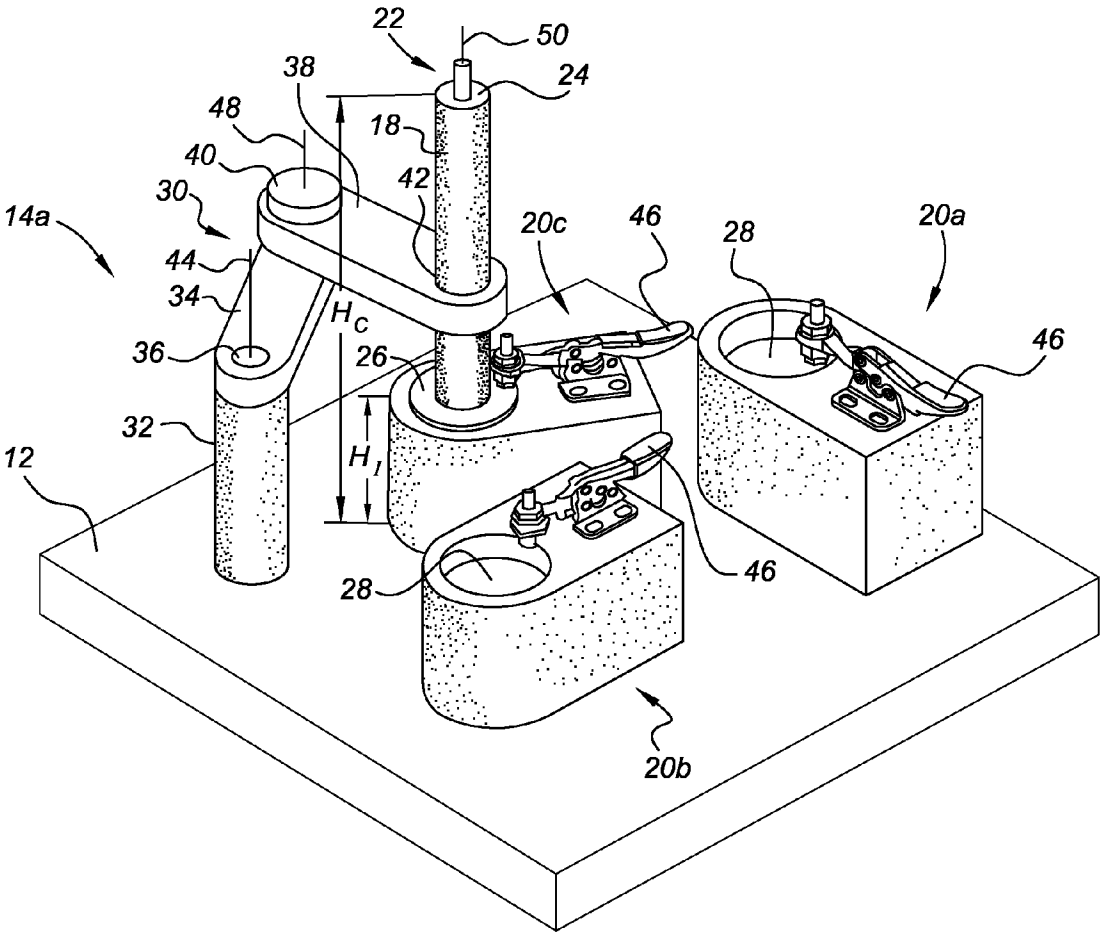
FIG. 2 is an enlarged perspective view of one support assembly for the pallet of the present invention.

FIG. 2 illustrates an enlarged perspective view of one section of the pallet 10 showing one of the support assemblies 14*a*. The other support assemblies 14*b-d* on the pallet 10 are configured in the same manner as described herein. The support assembly 14*a* includes a support element 18 and a plurality of bases 20. Preferably, there are multiple bases 20, one base for each version of the component to be supported. In the embodiment of FIG. 2, there are three bases 20: a first base 20*a*, a second base 20*b*, and a third base 20*c*. Therefore, the example embodiment is a pallet 10 for use with a component having three different configurations. For example, the component is an engine and three different engines are available for a vehicle assembled on the assembly line. The pallet 10 can be configured to support each version of the engine.

Additional versions of the component can be accommodated by adding another base 20 at the appropriate location for each support assembly 14.

The support element 18 includes a locator 22 along an end 24, as shown. The locator 22 corresponds to a predetermined location on the component which has a mount for alignment with the locator 22. The locator 22 is positioned at a specific location and height to correspond to the component mount. In the embodiment shown, the locator 22 is a pin that could correspond to a female receptacle defined by the component at the mount. For example, the component is an engine and a pin receiver is positioned on the engine at the component mount location. Alternately, the locator 22 may be a support plane that corresponds to a plane on the component at the mount. Other arrangements may be used for the locator 22, such as, a female receptacle defined by the locator 22 and a male coupling on the component at the mount.

The support element 18 is positioned in the desired base 20, in this instance base 20*c*. The support element 18 has a footing 26. The footing 26 is received by the desired base 20*c*. In the embodiment shown, the multiple bases 20*a-c* each have an interface 28 for receiving the footing 26. The interface 28 places the support element 18 in the desired x-y coordinate location. The interface height $H_I$ of the desired base 20*c* places the locator 22 at the appropriate component height $H_C$ for that version of the component. Therefore, each base 20*a-c* is associated with a specific x-y-z coordinate appropriate to the version of the component being supported on the pallet 10 by the base 20*a-c*.

Each support element 18 is constrained by a linkage assembly 30. The linkage assemblies 30 guide and support the support element 18 and ensure that there are no loose parts associated with the pallet 10 to prevent dropping parts during pallet 10 reconfiguration. However, the support element 18 could be detached from the linkage assembly 30 if so desired. Each linkage assembly 30 has a foundation 32 secured to the platform 12. A first arm 34 is rotatably connected to the foundation 32 with a first joint 36. A second arm 38 is rotatably connected to the first arm 34 with a second joint 40. An aperture 42 for receiving the support element 18 is defined by the second arm 38 and is positioned remotely from the second joint 40. The support element 18 can freely rotate and slide in the z-direction when located within the aperture 42.

The first joint 36 rotatably connects the first arm 34 to the foundation 32. The first arm 34 rotates about a first axis 44 that is oriented in the z direction. The second joint 40 rotatably connects the second arm 38 with the first arm 34. The second arm 38 rotates about a second axis 48 that is also oriented in the z direction, and is parallel to the first axis 44. The x-y coordinate location of the second axis 48 may be changed by rotating the first arm 34 about the first axis 44.

A locking mechanism 46 is associated with each base 20*a-c* to secure the support element 18 within the interface 28. Once the support element is located within the interface 28 and the locking mechanism 46 is secured, rotation of the first arm 34 about the first axis 44 and the second arm 38 about the second axis 48 is prevented. Securing the locking mechanism 46 prevents movement of the first arm 34 and the second arm 38 relative to the foundation 32 and thus, to the platform 12.

The support element 18 rotates within the aperture 42 about a third axis 50 that is oriented in the z direction and parallel to the first and second axes 44 and 48. The x-y coordinate location of the third axis 50 may be changed by rotating the second arm 38 about the second axis 48 when the support element 18 is not received within an interface 28. Once the footing 26 is received by the interface 28, the x-y coordinate location of the third axis 50 is fixed. The locking mechanism 46 prevents the support element 18 from slideably moving vertically, along the third axis 50. Additionally, gravity and weight of the component restrict the support element 18 from moving along the third axis 50 during pallet 10 usage.

To configure the support assembly 14*a* for another version of the component the locking mechanism 46 is released. The footing 26 is moved from the interface 28 of base 20*c* to the interface 28 of base 20*a* or 20*b*, as desired, and the support element 18 is moved within aperture 42 for vertical adjustment. The locking mechanism 46 of the desired base 20*a* or 20*b* is secured to fix the support element 18 in position.

To reconfigure the entire pallet 10 this is repeated for each of the support assemblies 14*a-d* located on the pallet 10. To ensure proper positioning of the support element 18 for each of the support assemblies 14*a-d* the bases 20 may be colored or numbered alike for each version of the component. That is, base 20*a* of support assembly 14*a* has a matching color to a similar base 20*a* of each of the support assemblies 14*b-d* on the pallet 10. Base 20*b* of support assembly 14*a* would have another color matching each similar base 20*b* of each of the support assemblies 14*b-d* and base 20*c* of support assembly 14*a* would have a third color matching each similar base 20*c* of each of the support assemblies 14*b-d*. Positioning the footings 26 for each support assembly 14*a-d* with similarly colored bases 20 to one another would ensure that the locators 22 are in the proper location for each version of the component. For example, the component is an engine and each version of the engine would have a color associated therewith. All of the bases 20 utilized to support that engine version would be the associated color.

Additionally, the bases 20*a-c* for each support assembly 14*a-d* may have different interface heights $H_I$ than one another. That is, the interface height $H_I$ for the base 20*a* of the support assembly 14*a* may differ from the interface height of the base 20*a* of the support assembly 14*b* which differs from the interface height of the base 20*a* of the support assemblies 14*c* and 14*d*. Alternatively, all the bases 20*a-c* may be of the same height to provide a universal base 20*a-c*. Shims may be located positioned between the universal bases 20*a-c* and the platform 12 to adjust the interface height $H_I$ to the desired level for each base 20*a-c*. The interface height $H_I$ for the bases 20*a-c* is determined by the component mount requirement at each support assembly 14*a-d* location for that version of the component.

Figure 3:
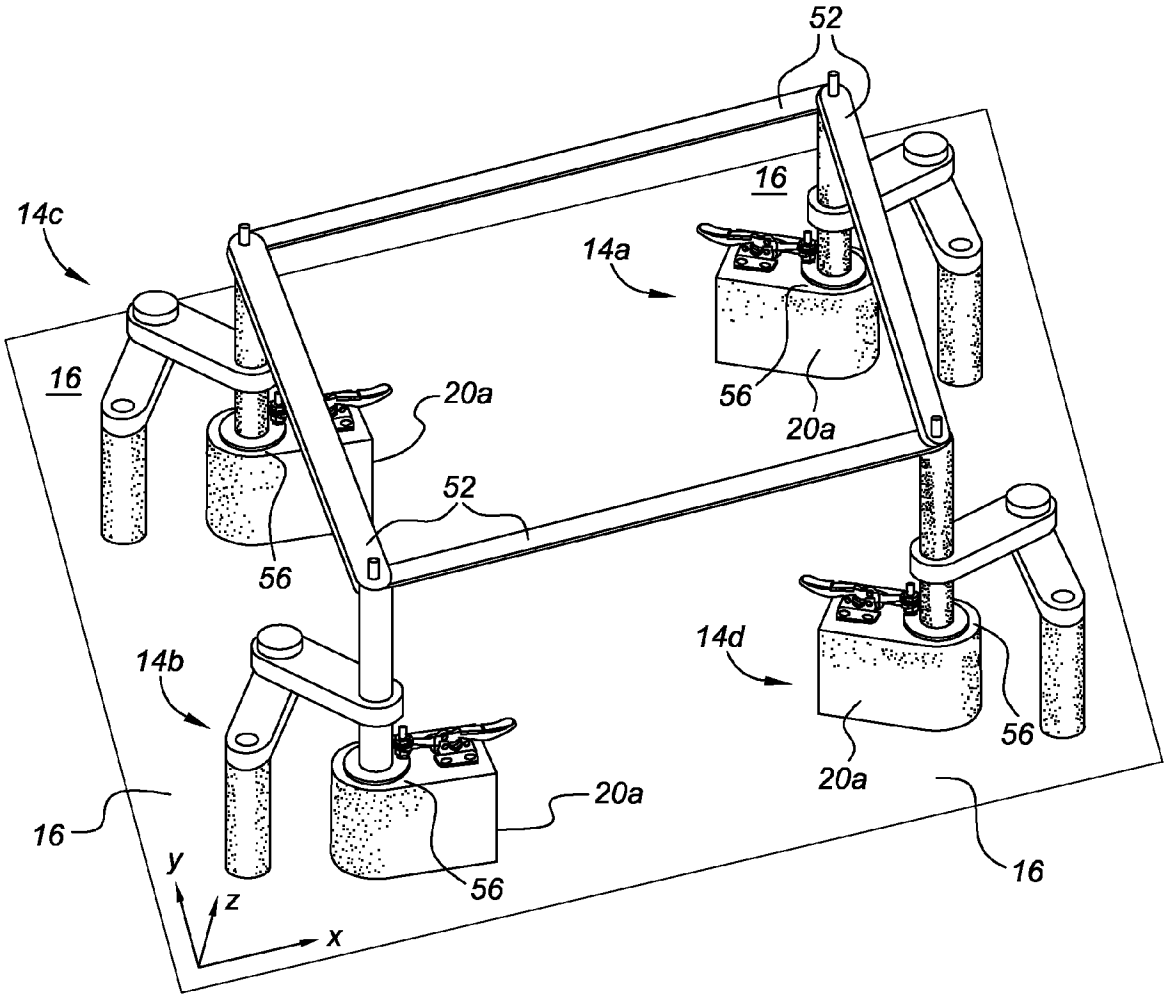
FIG. 3 is a perspective view illustrating the reconfigurable pallet of the present invention supporting a component.
Figure 4:
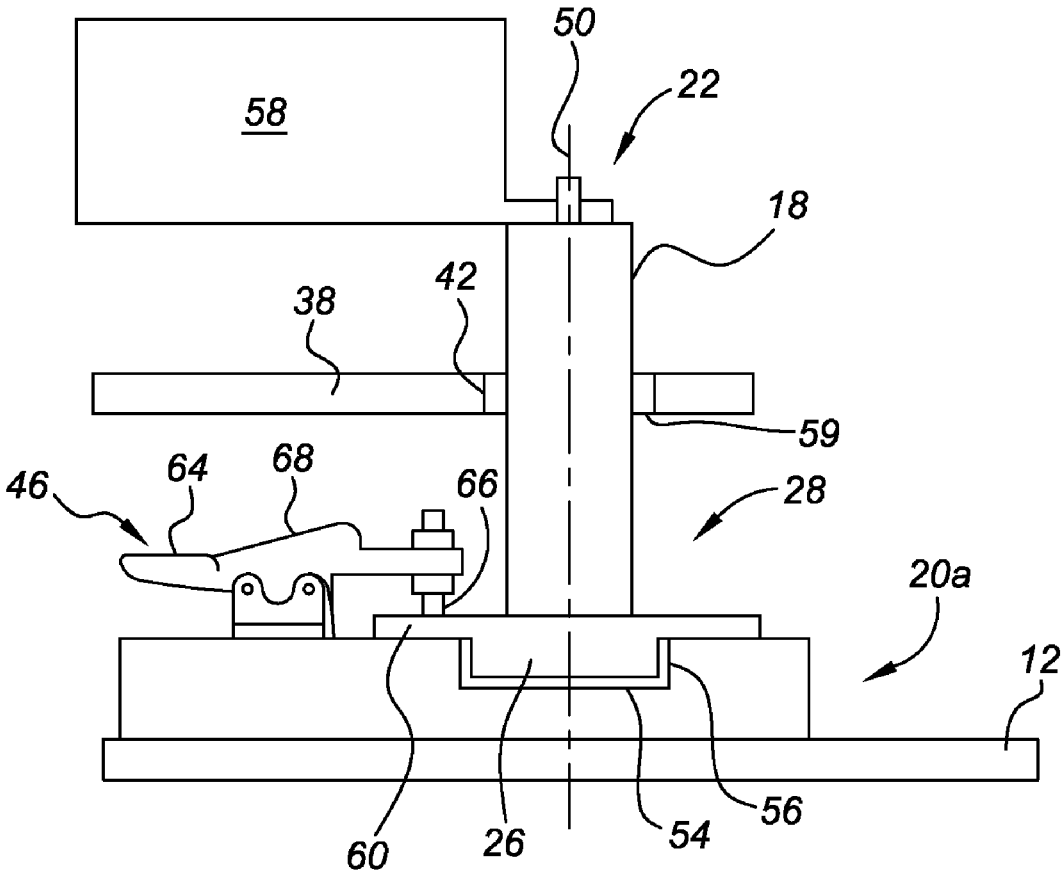
FIG. 4 is a side view of one support element located in a base of a support assembly for the pallet of the present invention.

FIG. 3 illustrates support of one version of a component on the pallet 10. The support elements 18 and bases 20*a* for the one version of the component are shown. The remaining bases 20*b-d* of the support assemblies 14*a-d* are removed for simplicity. The component to be supported is represented by rigid links 52. Each base 20*a* has an opening 54 (shown in FIG. 4) of the interface 28. Walls 56 of the interface 28 assist in preventing movement of the support element 18 and the footing 26. The walls 56 also absorb lateral forces, in the x or y direction, caused by the component during movement of the pallet 10. The walls 56 may have a greater height and diameter allowing the opening 54 to be larger than the footing 26. Greater depth of opening 54 allows the footing 26 to be fully seated with the top of the base 20*a* for locking the support element 18 in position. The greater diameter of the opening 54 allows footing 26 to be easily inserted and removed during reconfiguration of the pallet 10. The lateral clearance of the footing 26 within the opening 54 will however affect the tolerance of the locator 22 position. One skilled in the art would know the appropriate clearance required for operation and maintaining a desired tolerance for the locator 22 position. Additionally, chamfers may be located on walls 56 and footing 26 to allow the support element 18 be easily assembled and removed while providing further guidance in the position of the locator 22. Further, a vent may be located in the footing 26 or the base 20*a* to prevent air from being trapped within or sealing the opening 54 when the footing 26 is inserted. Note that as shown in FIGS. 2 and 4 the overall height, $H_C$, or z-location, of the locator 22 is determined by the combination of the z-dimensions of the support element 18 measured from the underside of enlarged portion 60 and the z-elevation, $H_I$, of the appropriate base 20. This facilitates cleaning of debris from the contacting surfaces to ensure the accuracy of the desired z-elevation, $H_I$. Similarly, the provision of a gap between the underside of footing 26 and the horizontal surface of opening 54 ensures that some debris may be accumulated in opening 54 without prejudicing the accuracy of the desired z-elevation, $H_I$.

FIG. 4 is a side view of one support element 18 located in a base 20*a*. The component is represented by an element 58 mounted on the locator 22. The footing 26 of the support element 18 is received by the opening 54 of the interface 28. The footing 26 has an enlarged portion 60 that has a greater diameter than the portion received within opening 54. The locking mechanism 46 applies a force to the enlarged portion 60 with a clamping part 66, when in the locked position as shown. The locking mechanism 46 clamps the footing 26 to the base 20*a*.

Walls 56 assist in absorbing lateral forces acting on the support element 18 by element 58. The second arm 38 of the linkage assembly 30 supports the support element 18. A bushing 59 may be located between the support element 18 and the second arm 38. The bushing 59 provides support to and allows rotational and vertical movement of the support element 18.

Figure 5:
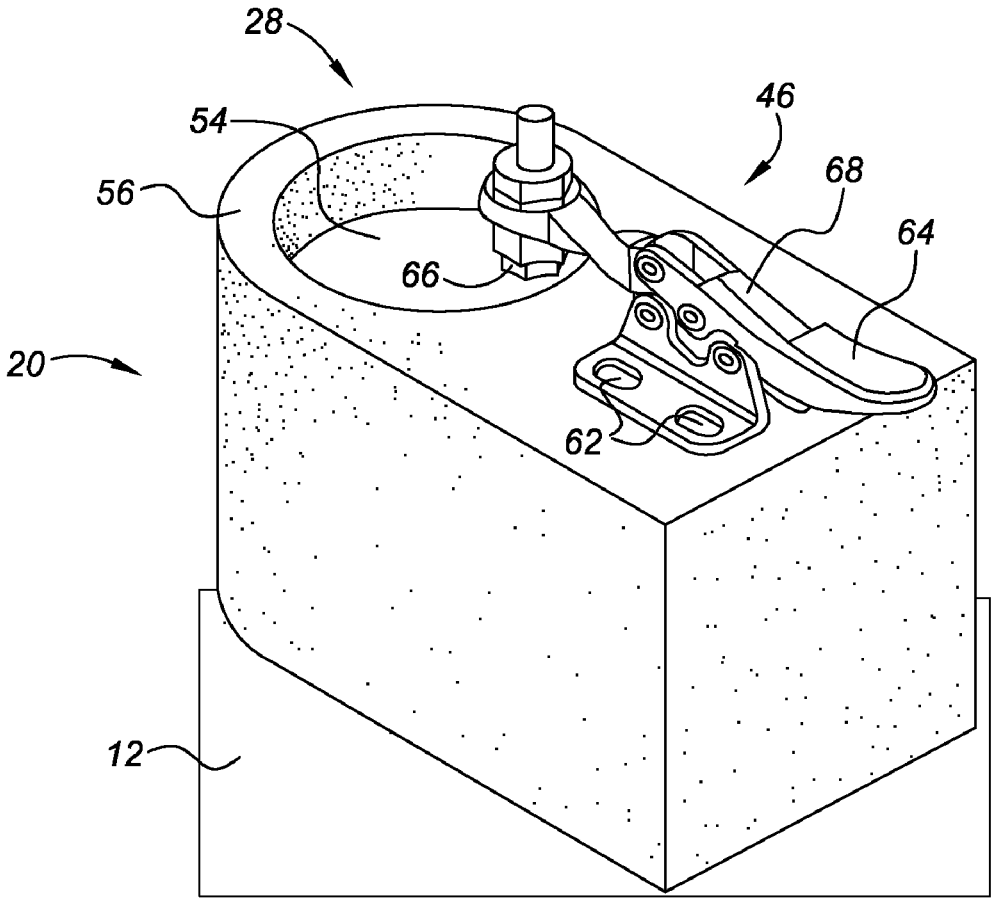
FIG. 5 is a perspective view of one base and locking mechanism of the support assembly for the pallet of the present invention.

FIG. 5 is an enlarged perspective view of the base 20 and the locking mechanism 46. The locking mechanism 46 is secured to the base 20 at multiple locations 62. The locking mechanism 46 is preferably a self-locking mechanism, such as an over-center toggle clamp, as shown. An actuator area 64 is located at an opposing end of a lever 68 from the clamping part 66. The actuator area 64 is provided for an assembly line operator to release the locking mechanism 46 allowing the footing 26 (shown in FIG. 4) to be moved in or out of the interface 28. Alternatively, the actuator area 64 could be configured for actuation by a robot associated with the assembly line. When the operator applies upward pressure to the actuator area 64 the locking mechanism 46 is released position. When downward pressure is applied to actuator area 64 the locking mechanism 46 moves to the locked position (as shown). Although one embodiment of the locking mechanism 46 is disclosed, other locking mechanisms 46 which would selectively retain footing 26 within interface 28 may be utilized.

In the above embodiments an example of the component to be supported is an engine. This is in no way meant to be restrictive and other components may be utilized with the reconfigurable pallet of the present invention.

While the best modes for carrying out the invention have been described in detail, those familiar with the art to which this invention relates will recognize various alternative designs and embodiments for practicing the invention within the scope of the appended claims.

The invention claimed is:

1. A pallet for supporting a component for assembly operations comprising:

a plurality of support assemblies each mounted to a platform, wherein each of the plurality of support assemblies includes a support element having a footing and which is moveable to a plurality of positions, a plurality of linkage assemblies mounted to the platform, wherein each of the plurality of linkage assemblies is rotatably connected via a joint to one of the plurality of support assemblies to enable movement of the respective support element, a plurality of bases each including an interface and defining one of the plurality of positions, each of the interfaces of the plurality of bases being configured for selectively receiving the footing of the respective support element, and a locking mechanism operatively connected to each of the plurality of bases to selectively fix the position of the support element relative to the platform;

wherein each of the plurality of bases is distinct from each support element and is located remotely from each support element.

2. The pallet of claim 1, wherein each support element is adjustable in a plurality of directions parallel to the platform via movement of one of the plurality of linkage assemblies and adjustable in a direction perpendicular to the platform via the plurality of bases and sliding of the support element relative to the one of the plurality of linkage assemblies.

3. The pallet of claim 2, wherein each of the plurality of linkage assemblies further comprises a foundation secured to the platform, a first arm rotatably connected to the foundation and a second arm rotatably connected to the first arm, wherein the second arm defines an aperture to slideably and rotatably receive the support element.

4. The pallet of claim 1, wherein the plurality of bases each comprise an interface to receive a footing of the support element, and wherein the interface has a predetermined height corresponding to a desired height for a locator on each support element at an opposing end from the footing.

5. The pallet of claim 1, wherein the each of the plurality of bases is secured to the platform in a fixed position such that the locator is in a desired position to support the component.

6. The pallet of claim 1, wherein each locking mechanism is mounted to one of the plurality of bases.

7. The pallet of claim 6, wherein each support element comprises an enlarged portion that is located between one of the plurality of bases and the clamping part of the locking mechanism when the support element is received by the one of the plurality of bases.

8. The pallet of claim 1, wherein each locking mechanism further comprises an actuator surface to actuate release of the locking mechanism, and a clamping part to apply a clamping force to the support element.

9. A support assembly for a reconfigurable pallet comprising:

a linkage assembly mounted to a platform;

a support element rotatably and slideably mounted to the linkage assembly, wherein the support element includes a footing;

a plurality of bases, wherein each of the plurality of bases includes an interface that is configured to selectively receive the footing of the support element; and a locking mechanism operatively connected to each base to selectively secure the support element to the base;

wherein each of the plurality of bases is distinct from the support element and is located remotely from the support element.

10. The support assembly of claim 9, wherein the linkage assembly further comprises a foundation secured to the platform, a first arm rotatably connected to the foundation and a second arm rotatably connected to the first arm, wherein the second arm defines an aperture to slideably and rotatably receive the support element.

11. The support assembly of claim 9, wherein each of the plurality of bases comprises an interface to receive a footing of the support element, and wherein the interface has a predetermined height corresponding to a desired height for a locator on each support element at an opposing end from the footing.

12. The support assembly of claim 9, wherein the locking mechanism is mounted to each of the plurality of bases.

13. The support assembly of claim 9, wherein the locking mechanism further comprises an actuator surface to actuate release of the locking mechanism, and a clamping part to apply a clamping force to the support element.

14. The support assembly of claim 13, wherein the locking mechanism is in a locked position when force is not applied to the actuator surface.

15. The support assembly of claim 13, wherein the support element comprises an enlarged portion that is located between one of the plurality of bases and the clamping part of the locking mechanism when the support element is received by the one of the plurality of bases.

16. A method for reconfiguring a pallet comprising:

guiding a support element with a linkage assembly to a position proximate to a desired base of a plurality of bases, wherein the support element includes a footing, wherein each of the plurality of bases includes an interface that is configured to selectively receive the footing of the support element, and wherein each of the plurality of bases is distinct from the support element and is located remotely from the support element;

positioning a footing for the support element in the desired base;

securing a locking mechanism operatively connected to the base to prevent movement of the support element relative to the base; and repeating the positioning the footing and securing the locking mechanism for each of the support elements associated with the pallet in order to reconfigure the pallet to support differently configured components for assembly operations.

17. The method of claim 16, further comprising actuating release of the locking mechanism for the support element prior to positioning the footing.

18. The method of claim 16, wherein the positioning the footing further comprises selecting a base associated with a component to be supported by the support element.

19. The method of claim 16, wherein the positioning the footing further comprises, sliding the support element in a direction perpendicular to the base to position the footing at the height of an interface on the base.

* * * * *